US010661303B2

(12) United States Patent
Upper

(10) Patent No.: US 10,661,303 B2
(45) Date of Patent: May 26, 2020

(54) PRODUCT AND METHOD FOR USE IN STREAMLINING SPRAY FOAM APPLICATIONS

(71) Applicants: Darren Watson, Saskatchewan (CA); Joe Upper, Alberta (CA)

(72) Inventor: Joe Upper, Alberta (CA)

( * ) Notice: Subject to any disclaimer, the term of this patent is extended or adjusted under 35 U.S.C. 154(b) by 775 days.

(21) Appl. No.: 15/095,384

(22) Filed: Apr. 11, 2016

(65) Prior Publication Data

US 2016/0296967 A1 Oct. 13, 2016

(51) Int. Cl.

| | |
|---|---|
| ***B05D 1/32*** | (2006.01) |
| ***B05B 12/20*** | (2018.01) |
| *B05D 1/02* | (2006.01) |
| *E04B 1/76* | (2006.01) |

(52) U.S. Cl.

CPC ..... *B05D 1/322* (2013.01); *B05B 12/20* (2018.02); *B05D 1/02* (2013.01); *E04B 1/7604* (2013.01)

(58) Field of Classification Search

None

See application file for complete search history.

(56) References Cited

U.S. PATENT DOCUMENTS

2002/0182157 A1* 12/2002 Grayson ..... A45D 40/16 424/64

2004/0069218 A1* 4/2004 Binder ..... B65H 71/005 118/200

* cited by examiner

*Primary Examiner* — Duy Vu N Deo

*Assistant Examiner* — Bradford M Gates

(74) *Attorney, Agent, or Firm* — Schwartz Law Firm, P.C.

(57) ABSTRACT

A method for masking a predetermined surface section prior to application of spray foam material and a masking tool are provided. An end portion of the masking tool is rubbed over the predetermined surface section such that a thin layer of the paraffin wax material is deposited thereon. The masking tool comprises a body made of a solid paraffin wax material. The body has a predetermined shape for holding the same while rubbing an end portion of the masking tool over the predetermined surface section. The paraffin wax material has a predetermined consistency such that during rubbing a thin layer of the paraffin wax material adheres to the predetermined surface section.

5 Claims, 5 Drawing Sheets

PRODUCT AND METHOD FOR USE IN STREAMLINING SPRAY FOAM APPLICATIONS

FIELD OF THE INVENTION

The present invention relates to the application of spray foam insulation in buildings, and more particularly, to a method and tool for masking wall sections and stud faces prior to the application of spray foam insulation.

BACKGROUND

The Department of Energy reports that every year the average traditional home wastes up to 40% of the energy used for heating and cooling as heat is transferred through poorly insulated or un-insulated walls forming the exterior shell of the house, as well as air moving through gaps, penetrations, and cracks.

To provide proper insulation in modern construction of new buildings or as retrofit, spray polyurethane foam is increasingly used to the extent that it has become an industry standard for insulation, since the spray foam is able to fill in cracks and crevices and polyurethane has the highest resistance to heat transfer, called R-value, per thickness of any common insulating product.

Unfortunately, when applying the polyurethane spray foam, wall surface sections—and stud faces—that are not intended for being insulated with the polyurethane spray foam, get covered with over-spray. Traditionally, these surfaces are cleaned by scraping off the over-spray, either by hand or using power tools, resulting in a labour intensive and time consuming process. Alternatively, masking tape and/or protective plastic sheets are used to cover these wall sections and/or stud faces prior to the application of the polyurethane spray foam, resulting in a labour intensive and time consuming process and substantial cost for the masking tape and/or the plastic sheets.

It is desirable to provide a method for masking wall sections and stud faces prior to the application of spray foam insulation that is simple and fast.

It is also desirable to provide a device for masking wall sections and stud faces prior to the application of spray foam insulation that is cost effective and enables a simple and fast masking process.

BRIEF SUMMARY

Accordingly, one object of the present invention is to provide a method for masking wall sections and stud faces prior to the application of spray foam insulation that is simple and fast.

Another object of the present invention is to provide a device for masking wall sections and stud faces prior to the application of spray foam insulation that is cost effective and enables a simple and fast masking process.

According to one aspect of the present invention, there is provided a method for masking a predetermined surface section prior to the application of spray foam material. A masking tool having a predetermined shape and being made of a solid paraffin wax material is provided. An end portion of the masking tool is rubbed over the predetermined surface section such that a thin layer of the paraffin wax material is deposited thereon.

According to another aspect of the present invention, there is provided a masking tool for masking a predetermined surface section prior to the application of spray foam material. The masking tool comprises a body made of a solid paraffin wax material. The body has a predetermined shape for holding the same while rubbing an end portion of the masking tool over the predetermined surface section. The paraffin wax material has a predetermined consistency such that during rubbing a thin layer of the paraffin wax material adheres to the predetermined surface section.

The advantage of the present invention is that it provides a method for masking wall sections and stud faces prior to the application of spray foam insulation that is simple and fast.

A further advantage of the present invention is that it provides a device for masking wall sections and stud faces prior to the application of spray foam insulation that is cost effective and enables a simple and fast masking process.

Accordingly, embodiments of the present invention provide a masking tool for masking a work surface onto which a spray foam material is to be applied, the tool comprising: a body portion, the body portion further comprising a grip portion and an end portion; wherein at least part of the end portion comprises a masking material;

In some embodiments, the body portion is configured to be held by a user by the grip portion, and the end portion is configured such that when the end portion contacts and is drawn along the work surface, a layer of masking material is transferred from the end portion to the work surface; and wherein the layer of masking material transferred to the work surface is substantially effective to prevent adherence of an applied spray foam material.

In some embodiments, the masking material comprises paraffin. In some embodiments, the masking material further comprises at least one additive selected from the group consisting of an ethylene-vinyl acetate copolymer, a microcrystalline wax, a polyethylene and a dye.

In some embodiments, the masking material has a melting temperature in a range from about 50° C. to about 70° C.

In some embodiments, a cross-section of the masking tool comprises one of a circle, an oval, a triangle, a trapezoid and a polygon.

Thus there is provided in some embodiments of the present invention, a masking tool for masking a work surface onto which a spray foam material is to be applied may include a body portion.

In some embodiments, the body portion may further include a grip portion and an end portion.

In some embodiments, at least part of the end portion comprises a masking material.

In some embodiments, the body portion is configured to be held by a user by the grip portion, and the end portion is configured such that when the end portion contacts and is drawn along the work surface a layer of masking material is transferred from the end portion to the work surface.

In some embodiments, the layer of masking material transferred to the work surface is substantially effective to prevent adherence of an applied spray foam material.

In some embodiments, the invention provides a method of masking a work surface prior to application of a spray foam material may include providing a masking tool, the masking tool comprising a grip portion and an end portion. In some embodiments, at least part of the end portion may include a masking material.

In some embodiments of the method, the body portion is configured to be held by a user by the grip portion, and the end portion is configured such that when the end portion contacts and is drawn along the work surface.

In some embodiments of the method, a layer of masking material is transferred from the end portion to the work surface.

In some embodiments, the method includes contacting the work surface with the end portion of the masking tool and moving the masking tool along a desired path, such that a layer of masking material is deposited to the work surface.

In some embodiments, the area of the work surface to which masking material has been applied comprises a masked area.

In some embodiments, such a method may further include applying spray foam material to the work surface, and then removing over-sprayed foam from the masked area.

In some embodiments, such a method may further include removing masking material from the masked area after the over-sprayed foam material has been substantially removed.

In some embodiments, such a method may further include providing a masking material that may include paraffin.

In some embodiments, the masking material may further include at least one additive selected from the group consisting of an ethylene-vinyl acetate copolymer, a microcrystalline wax, a polyethylene, and a dye.

In some embodiments, such a method may further include forming the masking tool such that a cross-section of the masking tool may include one of a circle, an oval, a triangle, a trapezoid and a polygon.

BRIEF DESCRIPTION OF THE SEVERAL VIEWS OF THE DRAWINGS

To easily identify the discussion of any particular element or act, the most significant digit or digits in a reference number refer to the figure number in which that element is first introduced. A preferred embodiment of the present invention is described below with reference to the accompanying drawings, in which.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

While the description of the preferred embodiments hereinbelow is with reference to masking a surface section of a concrete wall and stud faces, it will become evident to those skilled in the art that the embodiments of the invention are not limited thereto, but is also adaptable for masking various other construction surfaces and materials such as, for example, anchor bolts/plates cast in a concrete wall.

Figure 1A:
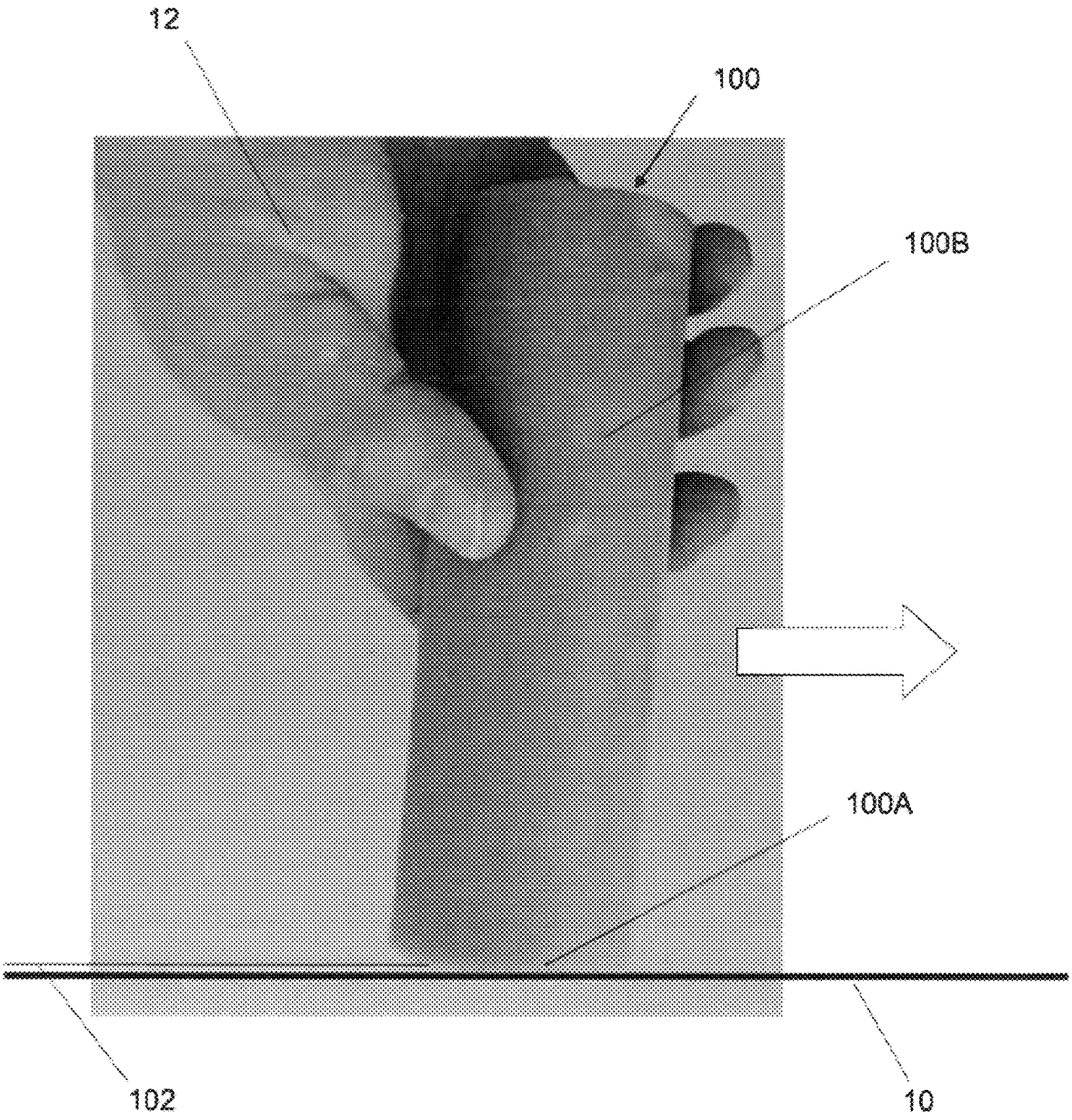
FIGS. 1*a* and 1*b* are simplified block diagrams illustrating in a side view and a top view masking of a predetermined surface section according to a preferred embodiment of the invention.
Figure 1B:
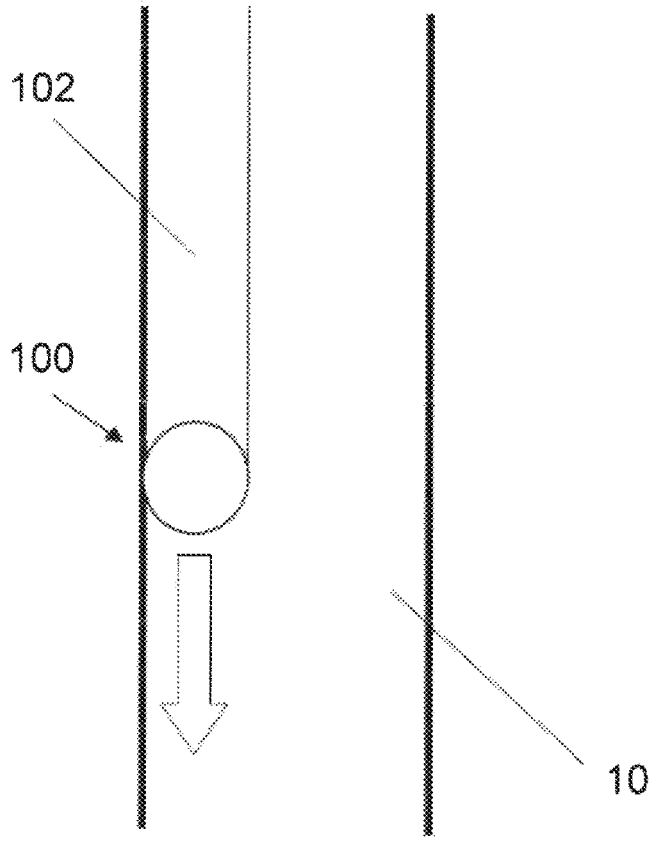

Referring to FIGS. 1*a* and 1*b*, a method for masking a wall section and stud faces prior to the application of spray foam material according to a preferred embodiment of the invention is provided. The method employs a masking tool 100 according to a preferred embodiment of the invention as will be described in more detail hereinbelow. The masking tool 100 has a predetermined shape and is made of a solid paraffin wax material. Using hand 12 a user of the masking tool 100 grips portion 100B of the masking tool 100 and moves the same over the surface 10—as indicated by the block arrow in FIG. 1—such that end portion 100A rubs over the surface 10. When rubbed over the surface 10 a thin layer 102 of the paraffin wax material is deposited thereon. The deposited paraffin wax material adheres to the surface 10 forming a stripe of thin protective coating 102 behind the masking tool 100 as the same is moved over the surface 10—as indicated by the block arrow in FIG. 1*b*. This process is performed until the desired surface area is covered with the protective coating being disposed, for example, in long parallel stripes, as illustrated in FIG. 1*b*, in a zigzag pattern, or circular pattern.

During application of the spray foam material, over-spray of the same is substantially prevented from coming into contact with the surface 10 by the layer 102 of the paraffin wax material. With the paraffin wax material acting as a release agent, the layer 102 together with the over-spray is easily removed after curing of the spray foam material, for example, by wiping or brushing the same off the surface 10. Optionally, remaining paraffin wax material may be removed using an organic solvent—such as, for example, ether, benzene, or some esters—or heat with the melting point of paraffin wax being typically between 50□C and 70□C.

Figure 2A:
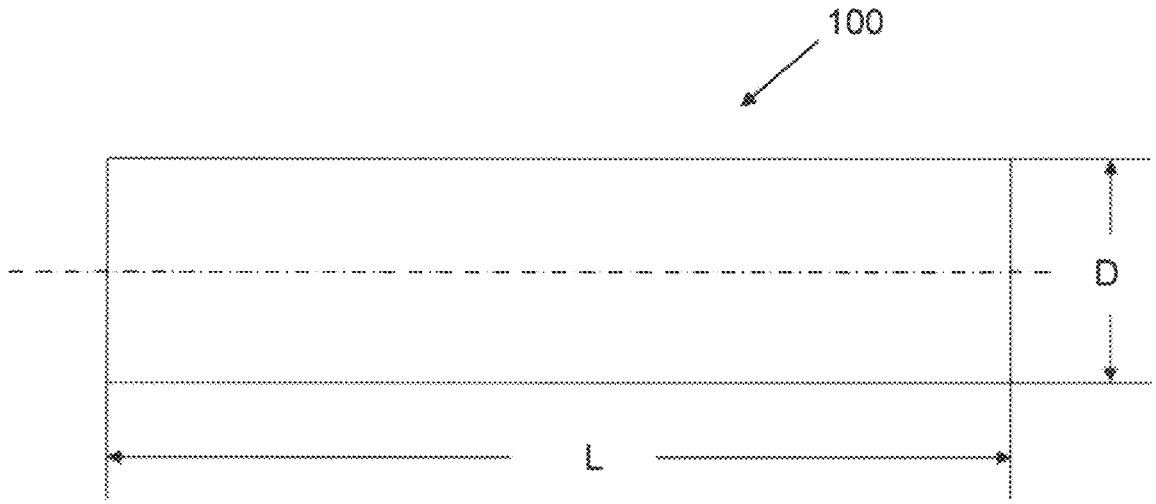
FIGS. 2*a* and 2*b* are simplified block diagrams illustrating a side view and a front view of a masking tool according to a preferred embodiment of the invention.
Figure 2B:
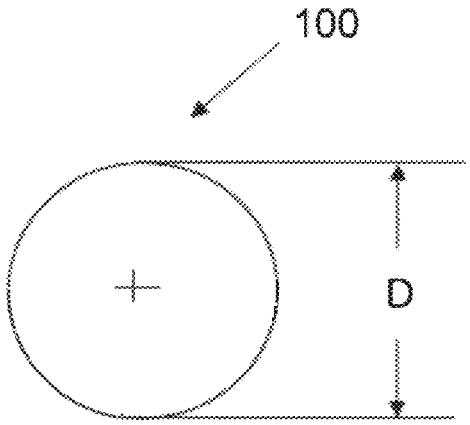

Referring to FIGS. 2*a* and 2*b*, a masking tool 100 for masking a predetermined surface section prior to the application of spray foam material according to a preferred embodiment of the invention is provided. The masking tool 100 comprises a body made of a solid paraffin wax material. The body has a predetermined shape enabling a good grip at portion 100B for holding the same while rubbing end portion 100A over the surface 10. Preferably, the body has a cylindrical shape with length L and diameter D. For example, for covering a larger surface area the body is provided having the dimensions: L=7.5"; and D=1.8". Of course, the masking tool 100 may be provided having other dimensions depending on user preference and size of the surface area to be covered. Alternatively, the body may have a different cross-section such as an oval cross-section or square cross-section.

Typically, the paraffin wax material is a composition of paraffin wax and additives such as, for example, Ethylene-Vinyl Acetate (EVA) copolymers, microcrystalline wax, or forms of polyethylene, in order for the paraffin wax material to have desired properties such as consistency/viscosity. Present day paraffin wax materials are readily available having a wide variety of properties.

Preferably, the masking tool 100 is made of a paraffin wax material that is sufficiently soft and pliable such that during rubbing a thin layer 102 of the paraffin wax material adheres to the surface 10, but is also sufficiently rigid such that only a thin layer 102 of the paraffin wax material is deposited onto the surface 10 and that the masking tool 100 doesn't break when rubbed over the surface 10.

Further preferably, a dye is added to the paraffin wax material in order to better visualize a masked surface area.

With the melting point of paraffin wax material being typically between 50□C and 70□C, the masking tool 100 is easily manufactured using standard technology such as, for example, melting the paraffin wax material and pouring the liquid paraffin wax material into a respective mold which is removed after cooling/solidifying of the paraffin wax material.

Figure 3:
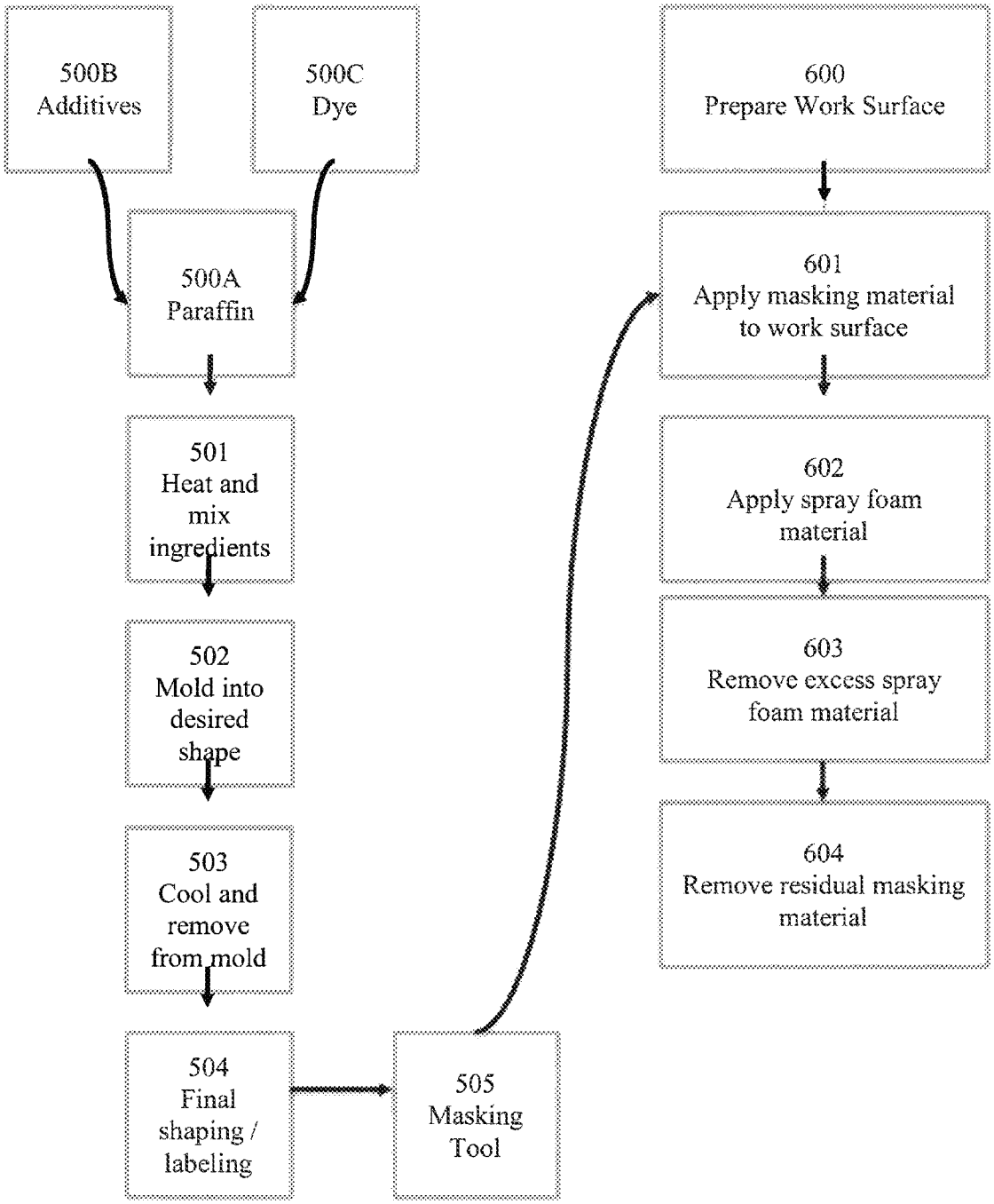
FIG. 3 is a flowchart depicting an embodiment of a method according to the present disclosure.

FIG. 3 depicts an embodiment of a flowchart for a method of masking a work surface to which a spray foam material is to be applied. As can be seen, one part of the method comprises fashioning a tool that can eventually be used to apply a masking material to a work surface prior to application of a spray foam material. In one embodiment of the method paraffin 500A (or other suitable material) can be combined with various additives 500B and a colorant or dye material 500C. Application of heat melts the paraffin and allows for mixing of the additives and dye with the paraffin to provide a relatively uniform material 501. The melted material can then be placed in a mold, the mold cavity shaped to form a desired shape for the masking material 502. The mold and masking material are cooled in order to transition the masking material back to a solid form, after which it can be removed from the mold 503. If desired, the molded masking material can be further shaped into virtually any desired shape, add a handle piece onto the masking material to provide a better grip for the user, and/or add labeling, that may include instructions as to the use of the masking tool 504. The finished product will be a masking tool 505, ready for use.

In making use of the tool, in some cases it may be preferred to first prepare the work surface to which a spray foam material will be applied 600. This may include the removal of loose or foreign material that might impede the attachment of the spray foam, or interfere with application of the masking material. A user can then apply the masking material as described above, by contacting the tool with the area of the work surface to be masked 601. Once masking is complete, a user can then apply the spray foam material 602. Once the spray foam material has set and/or cured, a user can then remove excess material from the masked area 603. The masking material makes removal much easier than it would otherwise be if no masking material had been used. If desired, a user might then remove residual masking material if so desired, other by heat, solvents, or a combination of cleaning techniques suitable for removing paraffin-based or like materials 604.

The present invention has been described herein with regard to preferred embodiments. However, it will be obvious to persons skilled in the art that a number of variations and modifications can be made without departing from the scope of the invention as described herein.

What is claimed is:

1. In combination with a spray foam material, a masking tool for masking a work surface onto which the spray foam material is to be applied, the tool comprising:

a body portion, the body portion further comprising a grip portion and an end portion;

wherein at least part of the end portion comprises a masking material;

wherein the body portion is configured to be held by a user by the grip portion, and the end portion is configured such that when the end portion contacts and is drawn along the work surface, a layer of masking material is transferred from the end portion to the work surface; and wherein the layer of masking material transferred to the work surface is substantially effective to prevent adherence of an applied spray foam material.

2. The masking tool of claim 1, wherein the masking material comprises paraffin.

3. The masking tool of claim 1, wherein the masking material further comprises at least one additive selected from the group consisting of an ethylene-vinyl acetate copolymer, a microcrystalline wax and a polyethylene.

4. The masking tool of claim 1, wherein the masking material has a melting temperature in a range from about 50° C. to about 70° C.

5. The masking tool of claim 1, wherein a cross-section of the masking tool comprises one of a circle, an oval, a triangle, a trapezoid and a polygon.

* * * * *